US005185955A

United States Patent [19]

Pedersen

[11] Patent Number: 5,185,955

[45] Date of Patent: Feb. 16, 1993

[54] SASH WINDOWS

[76] Inventor: Svend A. S. Pedersen, Tandrupvej 5, DK-7755 Bedsted Thy, Denmark

[21] Appl. No.: 676,900

[22] Filed: Mar. 28, 1991

[51] Int. Cl.[5] ..... E05D 15/10

[52] U.S. Cl. ..... 49/216; 49/183; 49/209

[58] Field of Search ..... 49/216, 209, 225, 176, 49/183

[56] References Cited

U.S. PATENT DOCUMENTS

| | | | |
|---|---|---|---|
| 1,185,783 | 6/1916 | Edwards | 49/209 |
| 1,919,371 | 7/1933 | Klemm | 49/183 X |
| 1,980,275 | 11/1934 | Julin | 49/183 X |
| 3,660,936 | 5/1972 | Bryson | 49/209 |
| 4,114,317 | 9/1978 | Crawley | 49/209 |
| 4,704,821 | 11/1987 | Berndt | 49/209 X |

*Primary Examiner*—Philip C. Kannan

*Attorney, Agent, or Firm*—Lee, Mann, Smith, McWilliams, Sweeney & Ohlson

[57] ABSTRACT

Sash windows of the type having two vertically sliding sashes placed in mutually offset planes for sliding so as to cover each other when opening the window, the sashes being guided in vertical guides (4) cut in a common frame (1), and wherein each sash is equilibrated, i.e. self-retaining, in any position by means of balance springs (5); the sashes being carried by sliding mountings consisting of slide block members (6) having projecting pins (9) engaging elongated oblique guiding grooves in the sash sides, to guide the sash relative to the sliding mountings—and therefore also relative to the pins—so that the sash is subjected to a plane-parallel displacement toward or away from the frame (1), to compress elastomer profiled sealing strips between the sash and the frame or between the middle sections of the sashes to obtain sealing of the window when closed.

19 Claims, 3 Drawing Sheets

SASH WINDOWS

BACKGROUND OF THE INVENTION

This invention relates generally to sash windows and more particularly to a fitting for a sash, or double sash, window having one or two vertically slidable window sashes in mutually offset planes for sliding so as to cover each other by opening of the window, the sashes being guided in vertical guideways in a common frame and having individual balance fittings (balance springs).

DESCRIPTION OF THE PRIOR ART

The sash-type window is easy to handle and provides good ventilation properties. A draw-back of the window, however, is that it is difficult to seal because the sliding movement of the sashes makes the use of ordinary sealing strips difficult. Sealing strips of extruded plastic/rubber and brush type sealings along the sashes and in sliding engagement with the sash so as not to impede the movement of the sash have been tried. However, the enhanced friction tends to prohibit normal opening and closing of the window.

Approaches in which the sealing strips only exercise a modest pressure against the sash so that the friction is only small have an inadequate sealing effect, and such sealing arrangements are sensitive to lopsidedness and dirt.

SUMMARY OF THE INVENTION

The purpose of the invention is to provide a sash window which is both easy to handle and well sealed. As set forth in claim 1, this purpose is achieved by providing a window comprising a frame, at least one sash element supported by block elements in slidable engagement with the frame, and closure means on the sash element, the closure means being effective when actuated to cause relative movement between the sash element and the block elements, each block element comprising at least one member in cooperable engagement with the sash element for urging the sash element toward a sealing face on the frame in response to the relative movement.

According to the invention, the sealing function is activated by operating the closure, thus effecting relative movement between the sash and the block members. Via the cooperable member the relative movement is translated, urging the sash towards the sealing face provided on the window frame.

According to the invention, the sash element itself is urged against the sealing face of the window frame in the closed position, avoiding the need for special movable sealing strips employed in previous constructions which may be rather fragile. Also, the sash element is urged toward the sealing face only upon actuation of the closure means and not permanently, thus avoiding the extra friction generated by sealing strips permanently touching the sash element. It might be said that the invention relies on the simple fact that sealing of the window is really only needed when the window is closed—when the window is open, any sealing along the frame by sealing strips has no effect anyway.

According to preferred embodiments of the invention, the sashes are carried by pins on sliding blocks which slide in vertical guides in the frame. Elongated oblique grooves, by means of which the pins engage the sashes, permit a plane-parallel cross-wise displacement of the sash toward and away from the frame. This crosswise displacement makes the use of usual elastic sealing strips between the frame and the sash possible. The sealing strips are compressed between the window parts when the window is completely closed for sealing the window. When the sash is open, i.e. offset from the frame, the sealing strips clear the frame, and the sash may slide vertically, unobstructed by the sealing strips. The order of magnitude of the crosswise displacement toward and away from the frame is preferably only a few millimeters.

The sash may be held in a normal open position by means of springs. When the sash is sealingly closed, this takes place against the force of these springs. According to the invention, the closing movement is brought about by means of a closure effecting relative movement between the sash and the block elements, e.g. a closure of the pasquil lock type. The closing effect of the pasquil lock type closure is suitably obtained by means of wedge-formed latch members by means of which the sash is positively engaged against the frame in a combined vertical and horizontal displacement movement guided by the pins and the oblique guiding grooves. The pasquil lock type fitting may be operated by means of an ordinary handle.

In a further embodiment of the invention, it is possible to open the sash by tilting it away from the (upper) pins. The tilting movement takes place by rotation about the (lower) pins and is restricted by built-in scissor-type fittings between the sash and the slide block members concerned. The tilting gives easy access to all window pane surfaces when cleaning the window so that the cleaning can take place from inside. Furthermore the fittings may be devised with a view to removing the sash as a whole from the frame. This feature makes the window easy to mount.

BRIEF DESCRIPTION OF THE DRAWINGS

The invention will now be illustrated in more detail with reference to the accompanying drawings in which.

DETAILED DESCRIPTION OF THE INVENTION

Figure 1:
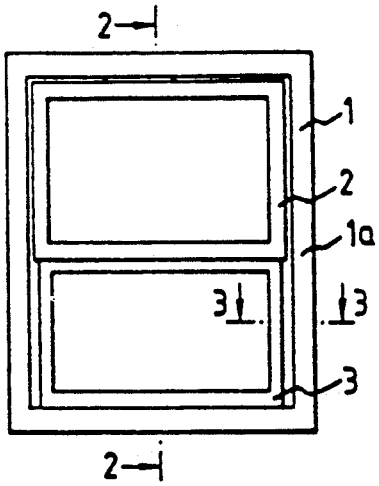
FIG. 1 shows a sash window of the invention in side view.
Figure 2:
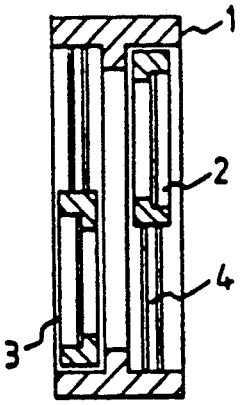
FIG. 2 is a vertical section along 2—2 of FIG. 1.
Figure 3:
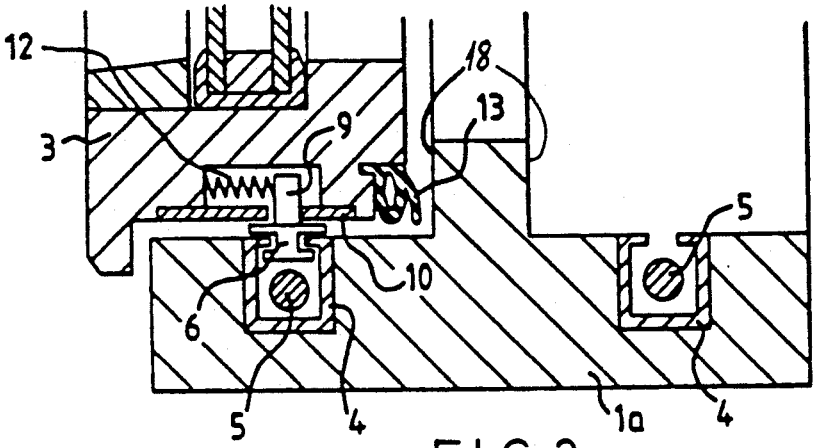
FIG. 3 is a magnified cross section of the vertical part of the frame of the window along 3—3 of FIG. 1.
Figure 4:
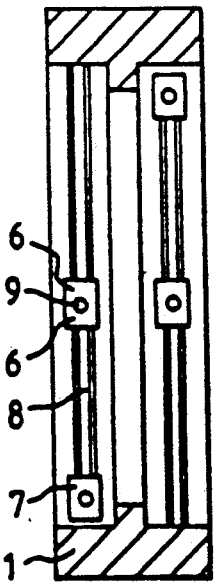
FIG. 4 is a vertical section, corresponding to FIG. 2, in which the sliding mountings of the window are shown.

With regard to FIG. 1, the window substantially consists of a frame 1, an upper sash 2 and a lower sash 3. The two sashes are in mutually offset planes, the upper sash being the outer member. The sashes are slidable in vertical cut-outs or guides 4 in the vertical sides la of frame 1. The window may be opened by sliding down the upper sash in front of the lower sash, or by sliding the lower sash up behind the upper sash, i.e. sliding one sash to cover the other. Each sash is in equilibrium by means of balance springs 5 in the guides 4. The balance springs make the handling of the window easier and retain the sashes in any desired position.

Figure 5:
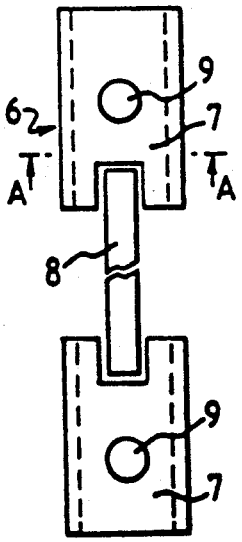
FIG. 5 shows separately one slide block of the sliding mounting.
Figure 5A:
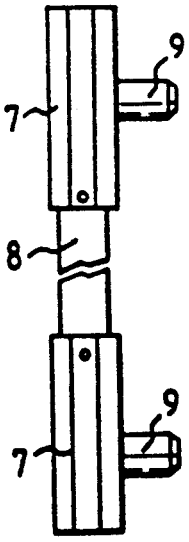
FIG. 5*a* shows the slide block in a side view.
Figure 5B:
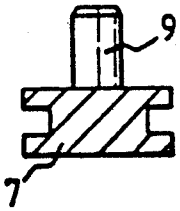
FIG. 5*b* shows the slide block in cross section along A—A of FIG. 5.

The guides 4 in the vertical parts la of the frame 1 are U-formed, the opening facing outward, each guideway guiding a slide block member 6 (FIG. 5) consisting of two profiled slide blocks 7 and a connector bar 8. The slide blocks have an I-profile and fit into the U-formed guides. The connector bar 8 is riveted to the slide blocks 7. In addition to connecting the slide blocks to each other, it also acts as an adaptor as it renders modifications for varying window sizes easy. The length of the slide block member preferably substantially corresponds to the vertical dimension of the sash.

Each slide block 7 carries, in solid connection, an outward-pointing-pin 9 carrying the sash concerned. The sash has upper and lower guide mountings 10 and 11. The guide mountings have oblique guiding grooves 10*a* and 11*a*, respectively, which are in engagement with the pins 9. The guiding grooves are parallel and therefore allow a plane-parallel movement of the sash, as a whole, toward and away from a sealing face 18 formed on the frame 1 opposite each sash, the pins at the same time sliding in the guiding grooves.

Grooves (not shown) beneath the guide mountings 10 and 11 receive springs 12 acting upon the pins 9, perpendicularly to their axis. The springs maintain the sash in its normal open position, i.e. the position in which the sash—by the combined effect of the guide mountings and the pins—is kept at a distance from the sealing face 18 on the frame. This distance is preferably of the order of magnitude of a few millimeters. In this position, the profiled sealing strips 13 of the sash are clear of the frame and the sash may now be slid up and down, carried by the slide block members 6 on either side and guided by the respective guides 4. As earlier mentioned, the sash is in equilibrium in any position by means of balance springs 5 connected to the slide block members (not shown).

On closing of the sash, it is subjected to a plane-parallel movement toward the sealing face 18 on the frame, the pins 9 sliding in the respective guiding grooves against the force of the springs 12. By this sliding movement the sealing strips 13 are compressed between the frame and the sash to obtain the sealing effect. The sealing strips may be well known articles or they may be specially devised for the invention. The sealing strips, as such, do not constitute part of the present invention. They are preferably extruded elastomer material. It is preferable that a similar strip or strips are inserted between the sashes to complete the sealing effect.

Figure 6:
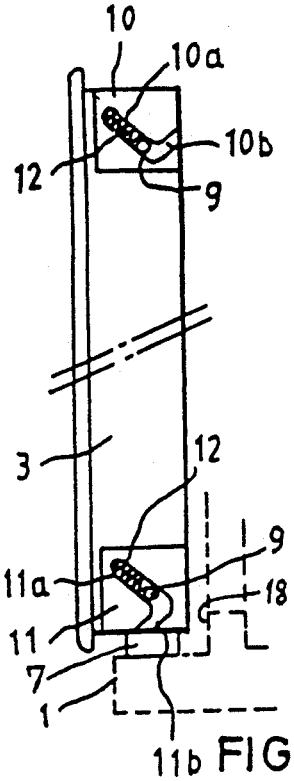
FIG. 6 shows the lower inner sash of the window schematically in side view and in opened position.
Figure 7:
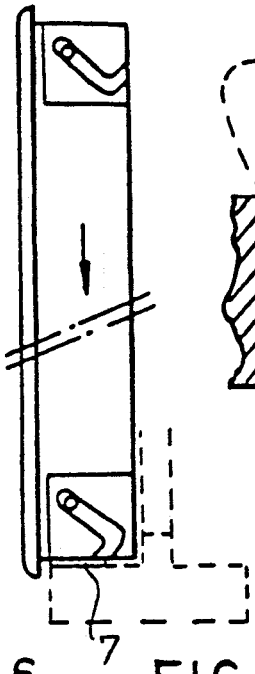
FIG. 7 shows the same in closed position.
Figure 9:
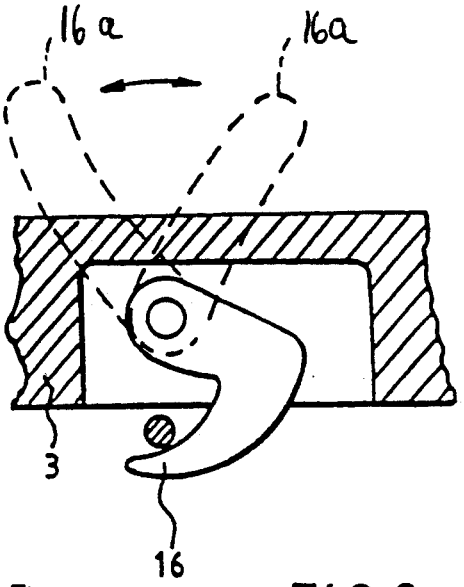
FIG. 9 shows a closure in another embodiment.

Closing of the sash is brought about by means of a specially devised closure 14. of the pasquil lock type, for instance. The closure functions as follows: when the sash slides to its closed position (usually downward for the lower sash, upward for the upper sash) the corresponding slide blocks 7 are stopped a few millimeters before the sash is completely closed; for that purpose the slide blocks 7 may be a few millimeters longer than the sash, such as shown in FIG. 6, so that the slide blocks will abut into complete contact with the frame. By means of the closure 14 the sash is now slid completely home against the force of the springs 12, the pins 9 sliding in their respective grooves, due to the oblique orientation of the latter. The closing movement thus brings about a simultaneous movement of the sash toward the sealing face 18 on the frame whereby sealing is obtained as described. When the sash is opened again, the springs 12 push the sash clear of the frame so that the sealing strips are disengaged.

Figure 8:
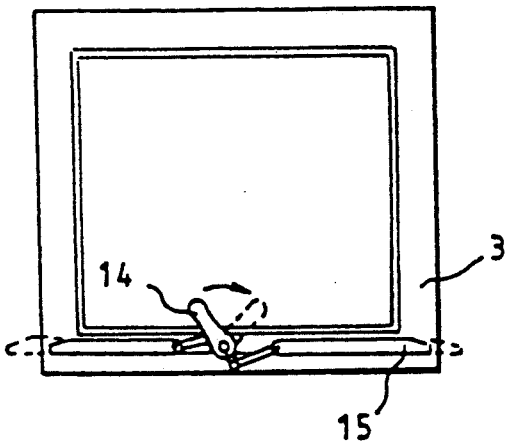
FIG. 8 shows the closure of the sash, schematically.
Figure 8A:
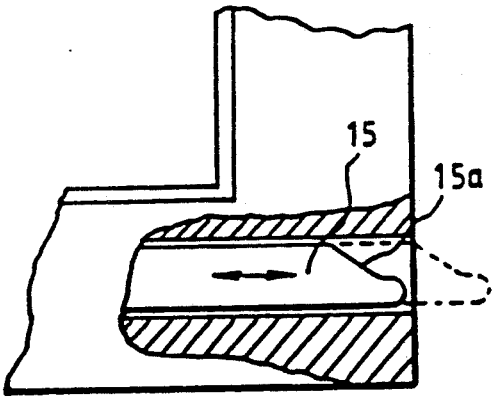
FIG. 8*a* shows an enlarged view of one end of the closure for the sash.

The pasquil type closure 14 is mounted in the lower horizontal part of the lower sash and in the upper horizontal part of the upper sash. The latch members 15 (FIGS. 8 and 8a) of the pasquil type closure have wedgeformed surfaces 15a to effect the desired controlled sliding movement of the sash when the pasquil closure is activated.

As an alternative to the pasquil closure 14, the sashes may be provided with hook-formed .closures 16 having the same effect. The closures 16 are activated by means of handles 16a in the same way as the pasquil type closure.

Figure 10A:
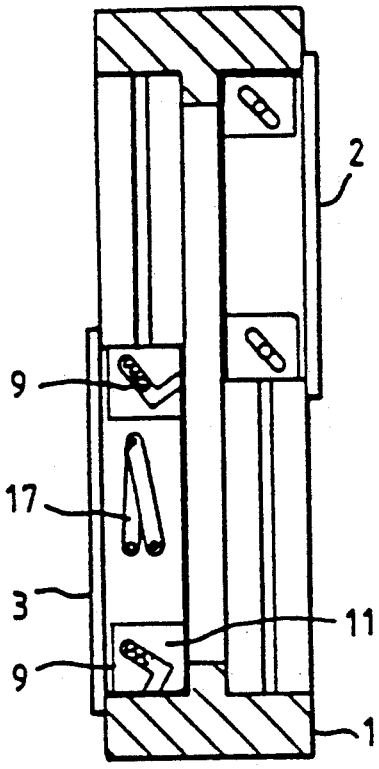
FIG. 10*a* shows a window of the invention with a demountable lower sash in a closed position.
Figure 10B:
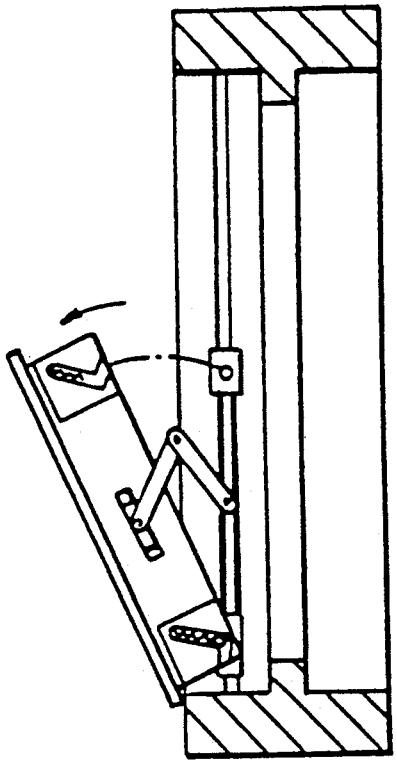
FIG. 10*b* shows the same window in which the sash is in an opened turned-out position.

In a further embodiment, lower sash 3 has fittings which permit inward-opening of the sash. Upper guide mountings 10 present angled guiding grooves 10*a*, opening to the rear, for the pins 9 (FIG. 6) so that the latter, in a manually effected controlled movement of the frame downward and outward, will clear the guiding grooves. By tilting about the lower pins the sash may then be swung out as shown in FIG. 10*b*. The scissor-type fitting 17 inserted between the sash and the slide block members restricts the opening of the sash to 45°.

Figure 10C:
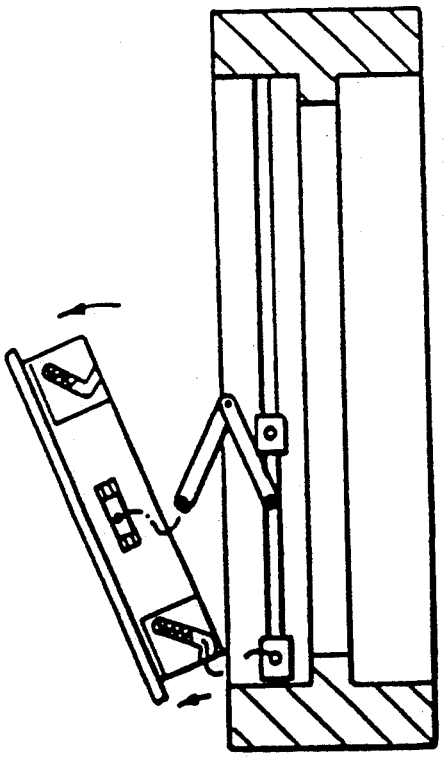
FIG. 10*c* shows the window in which the sash has been demounted.
Figure 11:
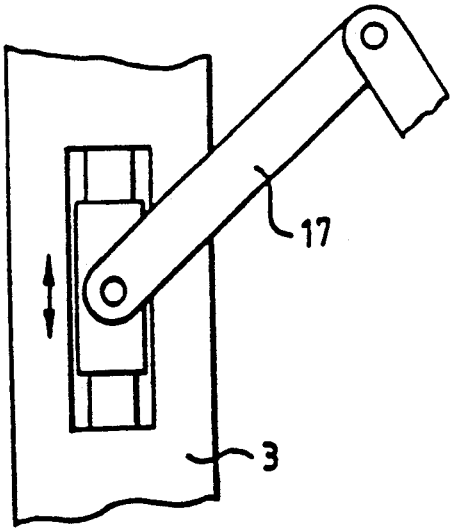
FIG. 11 is a detail of the scissor-type fitting of the sash.

Lower guide mountings 11 may also present open guiding grooves having downward and rearward-pointing angle leg parts 11*b* of the oblique guiding grooves 11*a*. These guiding grooves permit a dismounting of the sash as a whole (FIG. 10*c*). The scissor-type fittings 17 may be released from the sash by means of suitable detachable coupling means. With a view to the movement of the sash relative to the pins and the slide blocks during opening/closing, the coupling means may perform a restricted vertical sliding movement, for instance by being connected to vertically sliding coupling components inserted in the sash.

Preferably, at least upper guide mountings 10 have locking means (not shown) for the pins so that the sash is safeguarded against unintentional opening by any rearward tilting movement. Opening of the sash by tilting is preferably for cleaning the window.

What is claimed is:

1. A window comprising:

a frame, at least one sash element supported by block elements in slidable engagement with the frame, and closure means on the sash element, the closure means being effective when actuated to cause relative movement between the sash element and the block elements, each block element comprising at least one member in cooperable engagement with the sash element for urging the sash element toward a sealing face on the frame in response to the relative movement.

2. A window according to claim 1 wherein the member is a pin, and wherein the sash element comprises a guide mounting for each pin, each guide mounting having an oblique guiding groove cooperating with the pin.

3. A window according to claim 2 wherein each guide mounting comprises a spring between the pin and the sash element to urge the sash element away from the sealing face in the absence of actuation of the closure means.

4. A window according to claim 3 wherein at least one block element is an elongate slide block formed to protrude from the sash element so as to abut a stopping face on the frame when the sash element is near a closed position, and wherein the closure means is effective to draw the sash element toward the stopping face to effect the relative movement.

5. A window according to claim 4 wherein the closure means is a pasquil lock having wedge-shaped latch members.

6. A window according to claim 2 wherein at least one block element is an elongate slide block formed to protrude from the sash element so as to abut a stopping face on the frame when the sash element is near a closed position, and wherein the closure means is effective to draw the sash element toward the stopping face to effect the relative movement.

7. A window according to claim 6 wherein the closure means is a pasquil lock having wedge-shaped latch members.

8. A window according to claim 1 wherein at least one sealing strip is provided for sealing between the sash element and the sealing face.

9. A window according to claim 1 wherein the sash element is balanced to remain in any desired position.

10. A fitting for a sash window for the type having two vertically slidable window sashes placed in mutually offset planes for sliding so as to cover each other when opening the window, the sashes being guided in vertical guides in a common frame and being balanced to remain in any position, the fitting comprising:

two vertical guides for each sash, having an open hollow profile, the guides to be mounted one each at opposite sides of the frame;

an elongate slide block member to be slidably mounted in each guide;

a pin near each end of the slide block member;

a guide mounting for each pin to be mounted at a side of the sash facing the vertical guide, each guide mounting having an elongate oblique groove in use receiving the pin, all grooves in use running in parallel; and closure means to be mounted on the sash for effecting relative movement between the sash and the slide block members when actuated;

the guide mountings being effective in use to cooperate with the pins to urge the sash element toward a sealing face on the frame in response to the relative movement.

11. A fitting according to claim 10 wherein at least one guide mounting comprises a spring, the spring in use extending between the pin and the sash element to retain the sash element in a position retracted from the sealing face in the absence of actuation of the closure means.

12. A fitting according to claim 11 wherein the slide block members are formed to protrude from an end of the sash when in use, so as to abut the frame when the sash is near a closed position, and wherein the closure means is effective when actuated to draw the sash into the closed position, thereby effecting relative movement between the sash and the slide block members to urge the sash against the sealing face.

13. A fitting according to clain 11 wherein the closure means is a pasquil lock having wedge-formed latch members.

14. A fitting according to claim 10 wherein the slide block members are formed to protrude from an end of the sash when in use, so as to abut the frame when the sash is near a closed position, and wherein the closure means is effective when actuated to draw the sash into the closed position, thereby effecting relative movement between the sash and the slide block members to urge the sash against the sealing face.

15. A fitting according to claim 10 wherein the closure means is a pasquil lock having wedge-formed latch members.

16. A fitting according to claim 10 having two upper and two lower guide mountings, wherein the grooves in the two upper guide mountings are open at an end in use facing the sealing face so as to allow releasing the upper part of a sash from the upper pins by a combined translation and tilting movement, the fitting further comprising scissor-type fittings to be mounted between the sash and the slide block members for retaining teh sash in a position tilted away from the sealing face, e.g. for cleaning the sash.

17. A fitting according to claim 16, wherein the links of the scissor-type fittings are fastened to the sash to permit relative movement between the sash and the slide block members.

18. A fitting according to claim 16 wherein the grooves in the lower guide mountings are also open and the scissor-type fittings are releasable from the sash, the sash as a whole being detachable from the frame by pulling the sash away from all pins.

19. A fitting according to claim 18, wherein the links of the scissor-type fittings are fastened to the sash to permit relative movement between the sash and the slide block members.

* * * * *